US012453892B1

(12) United States Patent
Frampton

(10) Patent No.: US 12,453,892 B1
(45) Date of Patent: Oct. 28, 2025

(54) FINGER EXERCISE DEVICE

(71) Applicant: Good Morning Sunshine, LLC, Mobile, AL (US)

(72) Inventor: Jamie Lane Frampton, Mobile, AL (US)

( * ) Notice: Subject to any disclaimer, the term of this patent is extended or adjusted under 35 U.S.C. 154(b) by 152 days.

(21) Appl. No.: 18/210,611

(22) Filed: Jun. 15, 2023

(51) Int. Cl.

| | |
|---|---|
| ***A63B 23/16*** | (2006.01) |
| ***A63B 21/00*** | (2006.01) |
| ***A63B 21/02*** | (2006.01) |
| ***A63B 21/04*** | (2006.01) |
| ***A63B 21/055*** | (2006.01) |

(52) U.S. Cl.
CPC ..... *A63B 23/16* (2013.01); *A63B 21/00069* (2013.01); *A63B 21/023* (2013.01); *A63B 21/0421* (2013.01); *A63B 21/055* (2013.01); *A63B 21/4035* (2015.10); *A63B 21/4039* (2015.10); *A63B 2225/09* (2013.01)

(58) Field of Classification Search
CPC . A63B 23/16; A63B 21/00069; A63B 21/023; A63B 21/0421; A63B 21/055; A63B 21/4035; A63B 21/4039; A63B 2225/09
See application file for complete search history.

(56) References Cited

U.S. PATENT DOCUMENTS

| | | | | |
|---|---|---|---|---|
| 3,606,316 | A | 9/1971 | Krewer | |
| 3,738,651 | A | 6/1973 | Norman et al. | |
| 3,782,719 | A | 1/1974 | Kuhlman | |
| 4,105,200 | A | 8/1978 | Unger | |
| 4,350,335 | A | 9/1982 | Pasbrig | |
| 4,513,962 | A | 4/1985 | Robson | |
| 4,553,746 | A | 11/1985 | Lee | |
| 4,615,522 | A | 10/1986 | Plough | |
| 4,674,330 | A | 6/1987 | Ellis | |
| 4,678,181 | A | 7/1987 | Ditsch et al. | |
| 4,765,608 | A | 8/1988 | Bonasera | |
| 5,072,927 | A * | 12/1991 | Santos | A63B 21/045 482/901 |

(Continued)

FOREIGN PATENT DOCUMENTS

| | | | |
|---|---|---|---|
| GB | 2552358 | A | 1/2018 |
| WO | 2021167471 | A2 | 8/2021 |

OTHER PUBLICATIONS

Design U.S. Appl. No. 29/895,010, filed Jun. 15, 2023, titled "Finger Exercise Device," to Jamie Lane Frampton.

*Primary Examiner* — Andrew M Kobylarz
(74) *Attorney, Agent, or Firm* — AdamsIP, LLC; Stephen Thompson; J. Hunter Adams

(57) ABSTRACT

A finger exercise device is provided. The device has two arms pivotally attached to each other and a tension spring with an adjustable knob for varying tension on the spring. The spring is positioned on one side of a pivot point, and finger engagement portions of each arm are located on an opposite side of the pivot point. A user may engage one finger engagement portion with their thumb and the other finger engagement portion with one or more fingers of the same hand other than the thumb. The user may then perform a pinching or grasping motion to extend the spring and exercise and strengthen muscles in the hand and fingers. The device may include a separate arm member that is fixedly attached to one of the pivoting arms and includes an indicator for measuring user progress.

20 Claims, 10 Drawing Sheets

(56) References Cited

U.S. PATENT DOCUMENTS 5,147,256 A 9/1992 Silagy
5,156,581 A 10/1992 Chow
5,157,970 A 10/1992 Lewis, Jr.
5,281,192 A 1/1994 Nelson
5,299,991 A 4/1994 Sato
5,431,611 A 7/1995 Silagy
5,445,582 A 8/1995 Brown
5,451,191 A 9/1995 Beenken
5,514,052 A 5/1996 Charles et al.
5,527,240 A 6/1996 Chen
5,529,550 A 6/1996 Maycock, Jr. et al.
5,529,551 A 6/1996 Chin
5,723,785 A 3/1998 Manning
5,738,613 A 4/1998 Clayton
5,752,896 A 5/1998 White
5,820,577 A 10/1998 Taylor
5,890,999 A 4/1999 Kildani
5,935,045 A 8/1999 Lowe
5,957,813 A 9/1999 Macdonald
6,036,621 A 3/2000 Hancock
6,063,006 A 5/2000 Chiu
6,099,438 A 8/2000 Dawson
6,228,001 B1 5/2001 Johnson et al.
6,443,874 B1 9/2002 Bennett
6,450,924 B1 9/2002 Block
6,537,075 B1 3/2003 Valeri-Cuevas
6,817,967 B1 11/2004 Ott et al.
6,911,011 B2 6/2005 Haag
6,986,728 B2 1/2006 Kasun
7,160,228 B2 1/2007 Liu
7,210,172 B2 5/2007 Adams, Jr.
7,740,561 B2 6/2010 Kupferman
7,824,311 B1 * 11/2010 Hsu ..... A63B 23/16 482/126
7,824,312 B1 11/2010 Hsu
7,867,145 B2 1/2011 Bearden
7,887,462 B1 2/2011 Bearden
7,967,732 B2 6/2011 D'Addario et al.
8,157,709 B2 4/2012 Wilkinson et al.
8,343,015 B2 1/2013 Zachary
8,601,869 B2 12/2013 Miller
8,678,984 B1 3/2014 Poillucci
8,915,824 B2 12/2014 Roberts
8,968,158 B2 3/2015 Poli
9,005,084 B2 4/2015 Silagy
9,028,371 B2 5/2015 Trent
9,072,939 B2 7/2015 Silagy
9,114,280 B2 8/2015 Silagy et al.
9,289,171 B2 3/2016 Hogrel et al.
9,421,419 B1 8/2016 Goldberg
9,474,932 B1 10/2016 Goldberg
9,511,257 B2 12/2016 Jung
9,597,547 B1 3/2017 Goldberg
9,675,513 B2 * 6/2017 Vedeloff ..... A61H 1/0288
9,700,758 B1 7/2017 Goldberg
9,782,624 B2 10/2017 Braier et al.
10,022,585 B2 7/2018 Abdourazak
10,143,403 B2 12/2018 Ban et al.
10,252,105 B2 4/2019 Dickens
10,269,263 B2 4/2019 Carrick
10,596,413 B2 3/2020 Zerbo et al.
11,083,233 B2 8/2021 King, III
11,135,476 B2 10/2021 Daniel
11,400,341 B2 * 8/2022 Van Willigen ..... A63B 21/023
D967,913 S * 10/2022 Shang ..... D21/684
11,504,579 B2 11/2022 D'Addario et al.
11,554,291 B2 1/2023 Assad et al.
2003/0131710 A1 7/2003 Goldiner
2004/0003687 A1 * 1/2004 An ..... A63B 21/0004 606/206
2006/0038455 A1 2/2006 Pavwoski
2008/0103026 A1 * 5/2008 An ..... A63B 21/023 482/49
2008/0300112 A1 12/2008 Crout
2009/0017993 A1 1/2009 Khanicheh et al.
2009/0156367 A1 6/2009 Harris, Jr. et al.
2011/0281688 A1 11/2011 Harris, Jr. et al.
2012/0059290 A1 3/2012 Yip
2012/0157263 A1 6/2012 Sivak et al.
2012/0179226 A1 7/2012 Graham et al.
2015/0165268 A1 6/2015 Nicoud
2019/0255383 A1 * 8/2019 An ..... A63B 21/00072
2021/0008410 A1 1/2021 Athanasiou et al.
2021/0369535 A1 12/2021 Ishimine et al.

* cited by examiner

FINGER EXERCISE DEVICE

FIELD OF THE INVENTION

The present disclosure relates generally to a finger exercise device for strengthening and rehabilitating muscles in the fingers and hand of a user.

BACKGROUND

Various types of finger and hand exercising devices have been developed for strengthening muscles in the fingers and hands. Such devices may be used or specifically designed for various purposes. For instance, some are designed for general strength training of muscles in the fingers and hands or for physical therapy to mitigate effects of physiological dysfunction. In other instances, exercising devices may be more specifically designed for specific types of tasks or for rehabilitation following trauma or surgery to increase strength and functional performance following injury. However, many known exercise devices are generally difficult to use, particularly for individuals who have suffered significant injuries to the hand and fingers, or are not ergonomically correct, particularly for strengthening and rehabilitating the muscles of the hands and fingers that are used for pinching and grasping motions. Many of these devices utilize compression springs designed to exercise hands and fingers when compressing one or more springs of the device. For some users with significant injuries, this type of exercise can be difficult to perform. Further, many of the known devices are designed to allow a user to perform a wide range of different exercises using a single device, which results in the device not being ergonomically designed for particular types of exercises, such as pinching and grasping exercises.

In addition, known devices do not have a convenient and reliable mechanism for measuring rehabilitation progress when using the device over a period of time, which is important for some patients, such as those who have undergone major procedures such as hand reconstruction surgery. The ability to measure a patient's progress in rebuilding muscle strength in the hands and fingers allows the patient to objectively evaluate the trajectory of the patient's progress, which may provide benefits to the patient throughout the rehabilitation process and may also provide objective input for reimbursement of medical expenses by insurers.

SUMMARY

In one aspect, a finger exercise device and a method of using the device for exercising and strengthening certain muscles in the fingers and hand of a user are provided. The device comprises a first arm member and a second arm member each having a first end and an opposing second end. The first arm member and the second arm member are pivotally attached to each other by a pivot pin that allows rotational movement of the first arm member and the second arm member relative to each other. The first end of the first arm member and the first end of the second arm member are disposed on the same side of the pivot pin, and the second end of the first arm member and the second end of the second arm member are also disposed on the same side of the pivot pin but on an opposing side of the pivot pin from the first end of each arm member. The first end of the first arm member is shaped to define a first finger engagement portion and the first end of the second arm member is shaped to define a second finger engagement portion. The device further comprises a tension spring having a first end and an opposing second end. A force adjuster knob is connected to the second end of the second arm member, preferably by a threaded connection. The first end of the spring is connected to the second end of the first arm member and the second end of the spring is connected to the force adjuster knob that is connected to the second end of the second arm member. The force adjuster knob is configured to adjust tension on the spring in response to rotation of the force adjuster knob, which extends or compresses the spring depending on the direction of rotation of the knob.

The device is configured to move between a static position and an extended position. In the static position, the second end of the first arm member and the second end of the second arm member are in contact with each other and retained in place by the tension of the spring. In the extended position, the second end of the first arm member and the second end of the second arm member are separated from each other in response to rotational movement of the first arm member and the second arm member relative to each other. When not in use, the device remains in the static position due to the tension of the spring. To use the device, a user engages the first and second finger engagement portions with their fingers. For instance, the user may engage the first finger engagement portion with their index finger and middle finger and also engage the second finger engagement portion with their thumb. The user may then perform a pinching or grasping motion to pivot the first and second arm members relative to each other, which extends the spring and thus moves the device from the static position into the extended position. The extended position encompasses a range of motion of the first and second arm members relative to each other and thus a range of tensioning force on the spring. The extended position may encompass a range of motion between the static position and a position of full extension of the spring, which is limited by the range of possible pivoting motion of the first and second arm members relative to each other.

In a preferred embodiment, the device further comprises a curved arm attached to the first arm member. The curved arm extends from the first arm member toward the second arm member, which has an opening extending through the second arm member. The curved arm is slidably disposed within the opening so that the curved arm can slide through the opening and back and forth within the opening as the first end of each of the arm members are pivoted toward each other to extend the spring and away from each other to allow the spring to return to a compressed state. The curved arm includes an indicator that visually indicates how far the curved arm has slidably moved through the opening, which indicates the degree of extension of the spring, thereby providing an indication of the force exerted on the arm members by the user.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DESCRIPTION OF THE DRAWINGS

These and other features, aspects, and advantages of the present invention will become better understood with regard to the following description, appended claims, and accompanying drawings where:

DETAILED DESCRIPTION

In the Summary above and in this Detailed Description, and the claims below, and in the accompanying drawings, reference is made to particular features, including method steps, of the invention. It is to be understood that the disclosure of the invention in this specification includes all possible combinations of such particular features. For example, where a particular feature is disclosed in the context of a particular aspect or embodiment of the invention, or a particular claim, that feature can also be used, to the extent possible, in combination with/or in the context of other particular aspects of the embodiments of the invention, and in the invention generally.

The term "comprises" and grammatical equivalents thereof are used herein to mean that other components, ingredients, steps, etc. are optionally present. For example, an article "comprising" components A, B, and C can contain only components A, B, and C, or can contain not only components A, B, and C, but also one or more other components.

Where reference is made herein to a method comprising two or more defined steps, the defined steps can be carried out in any order or simultaneously (except where the context excludes that possibility), and the method can include one or more other steps which are carried out before any of the defined steps, between two of the defined steps, or after all the defined steps (except where the context excludes that possibility).

Figure 1:
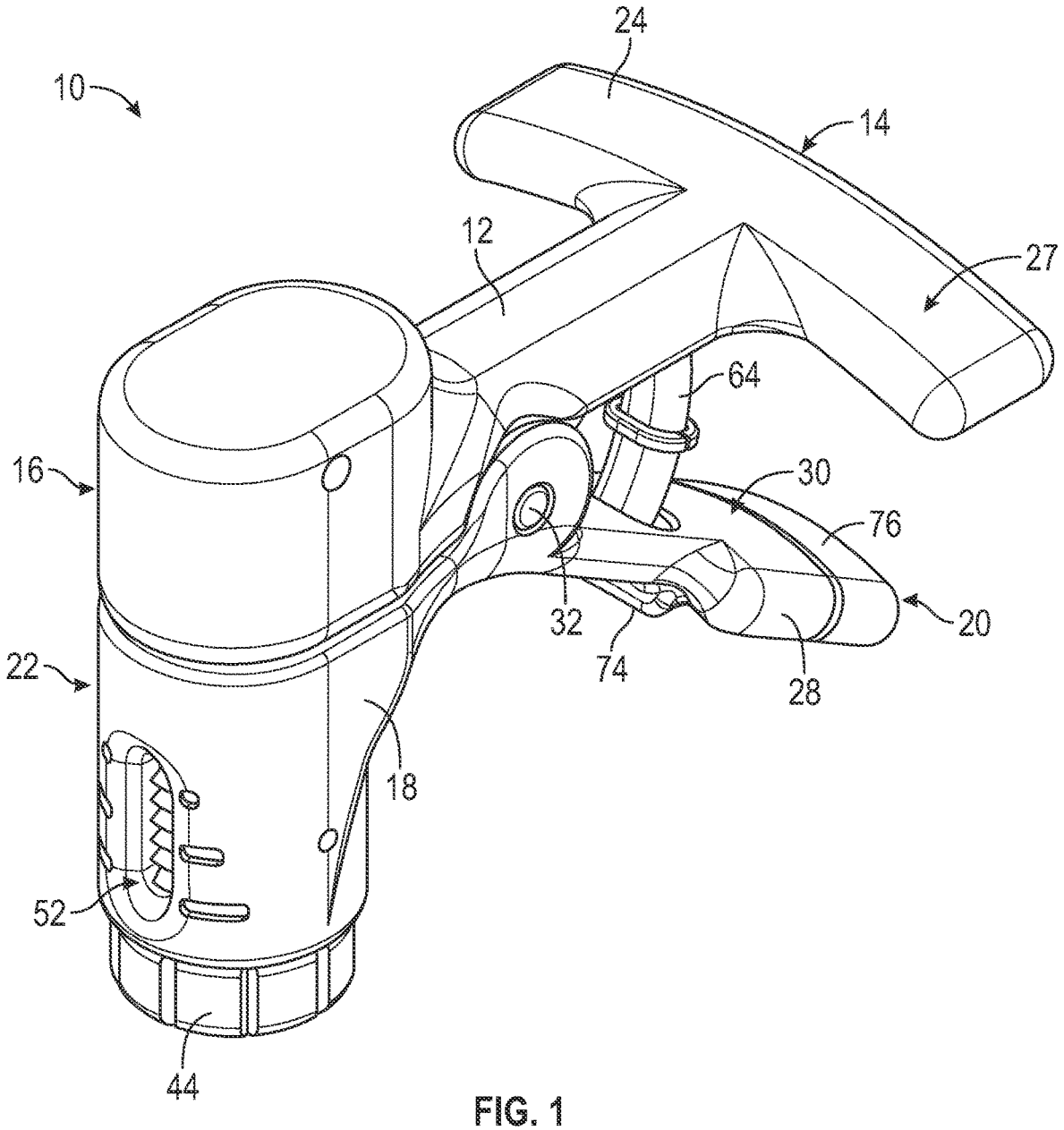
FIG. 1 shows a top perspective view of a finger exercise device in accordance with the present disclosure.
Figure 2:
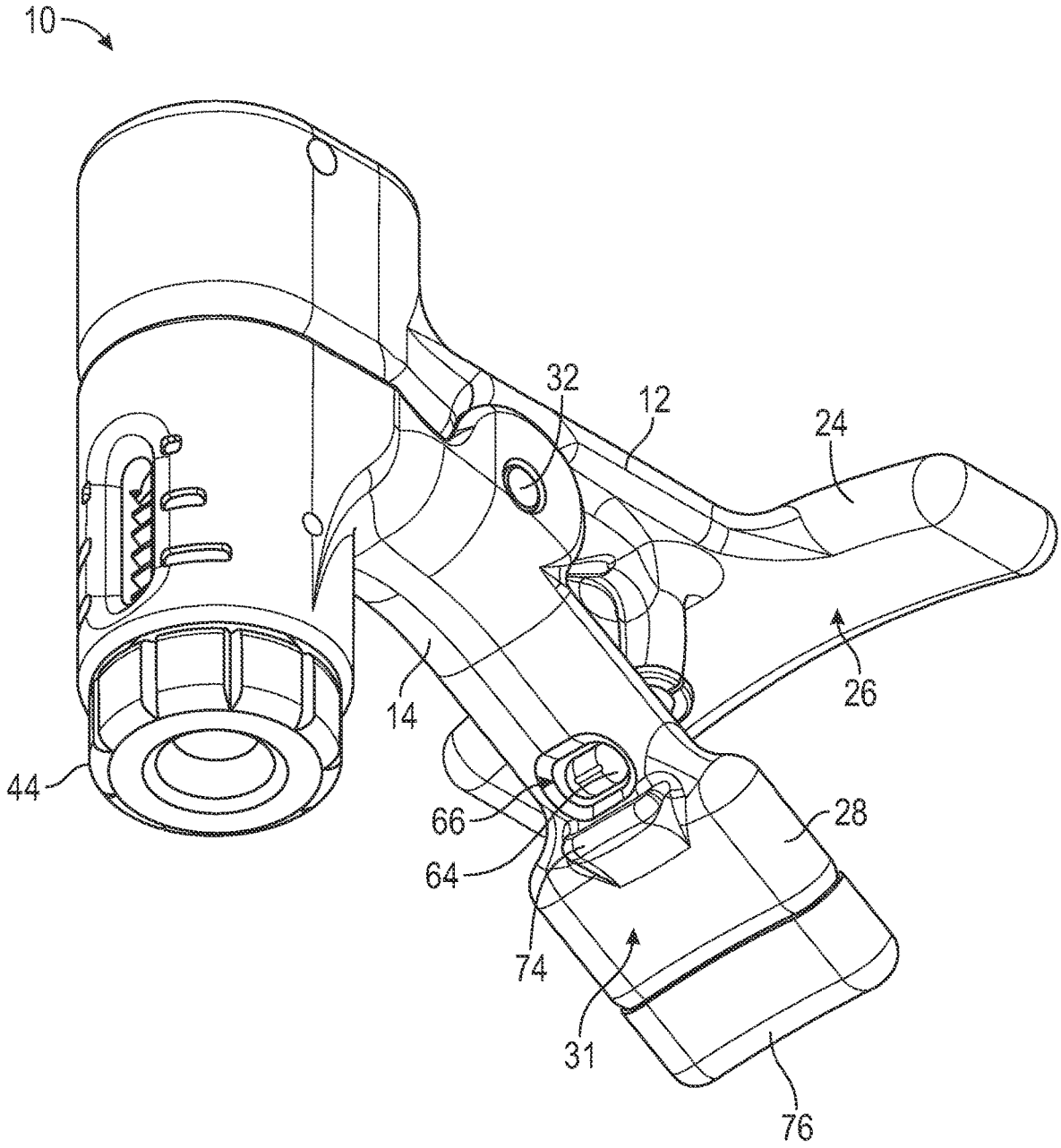
FIG. 2 shows a bottom perspective view of a finger exercise device in accordance with the present disclosure.
Figure 3:
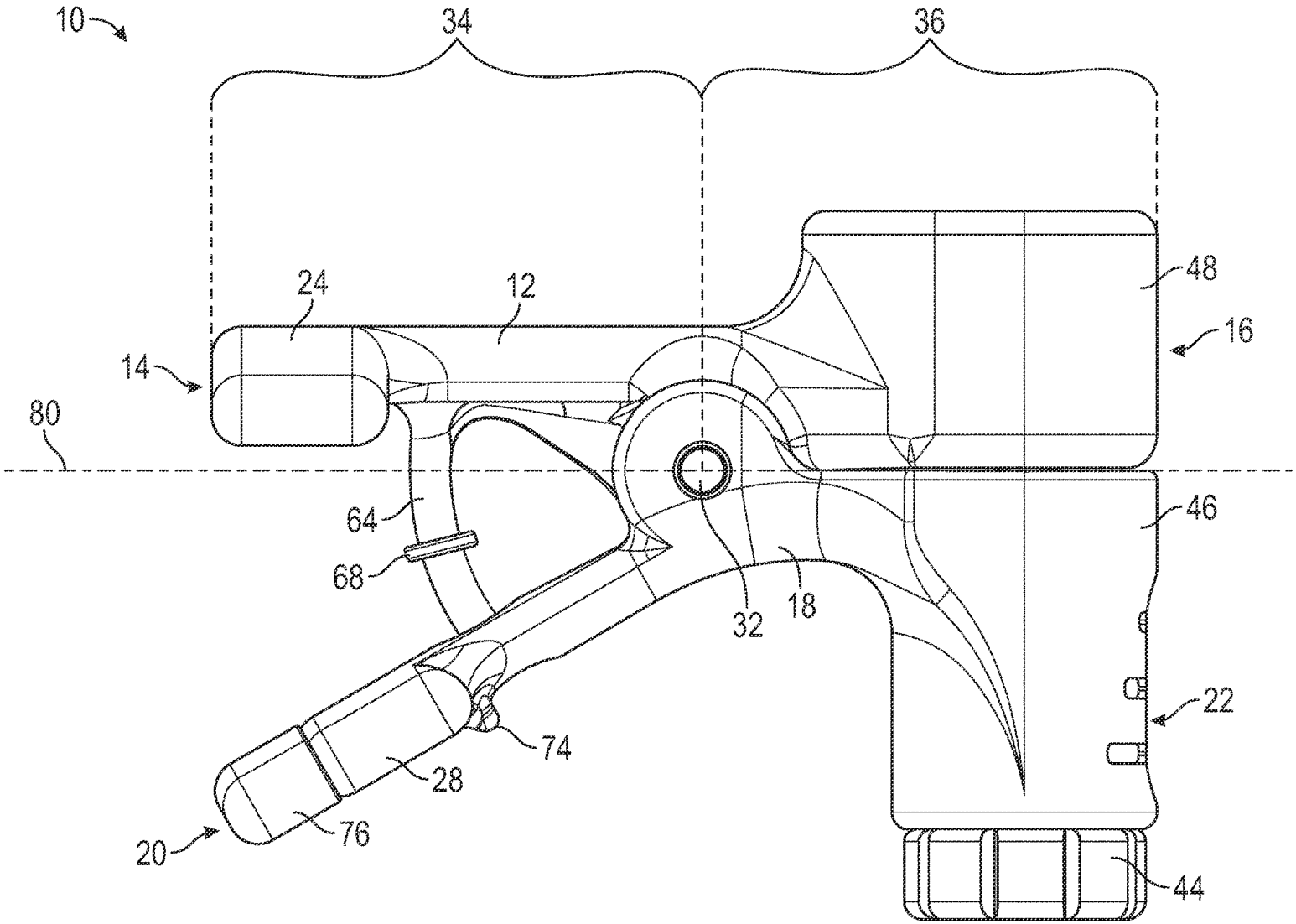
FIG. 3 shows a side elevational view of a finger exercise device in a static position in accordance with the present disclosure.
Figure 8:
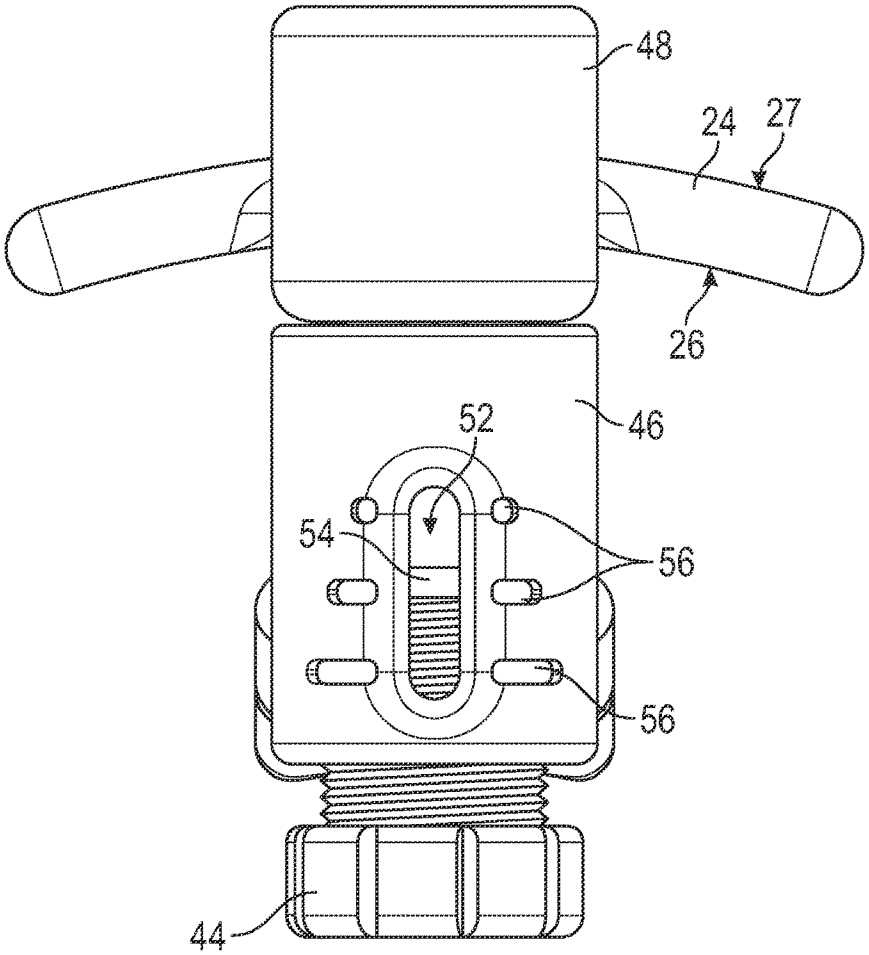
FIG. 8 shows a front view of a finger exercise device with an adjustment knob rotated to adjust spring resistance in accordance with the present disclosure.
Figure 9:
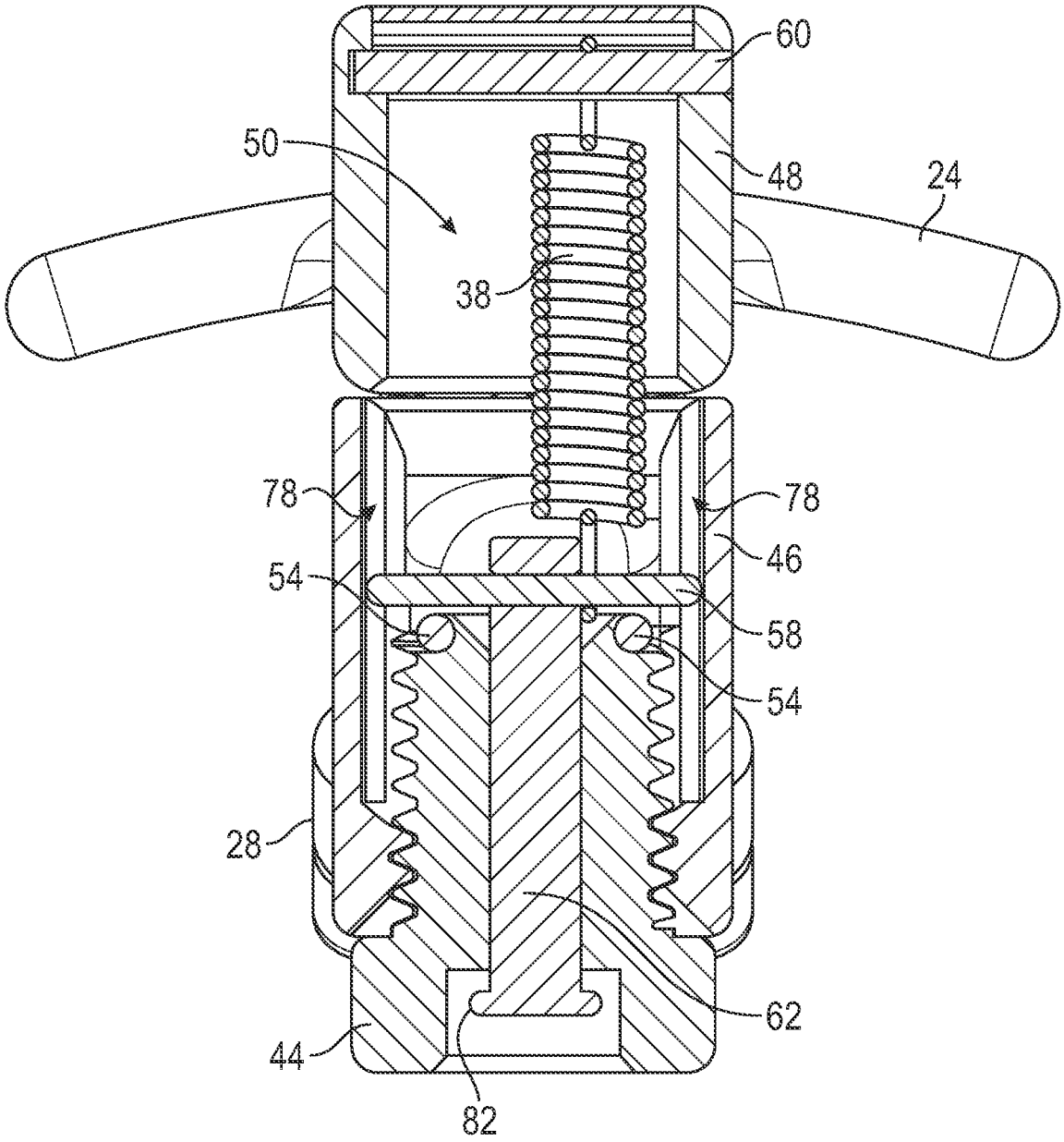
FIG. 9 shows a front cross sectional view of a finger exercise device in accordance with the present disclosure.
Figure 10:
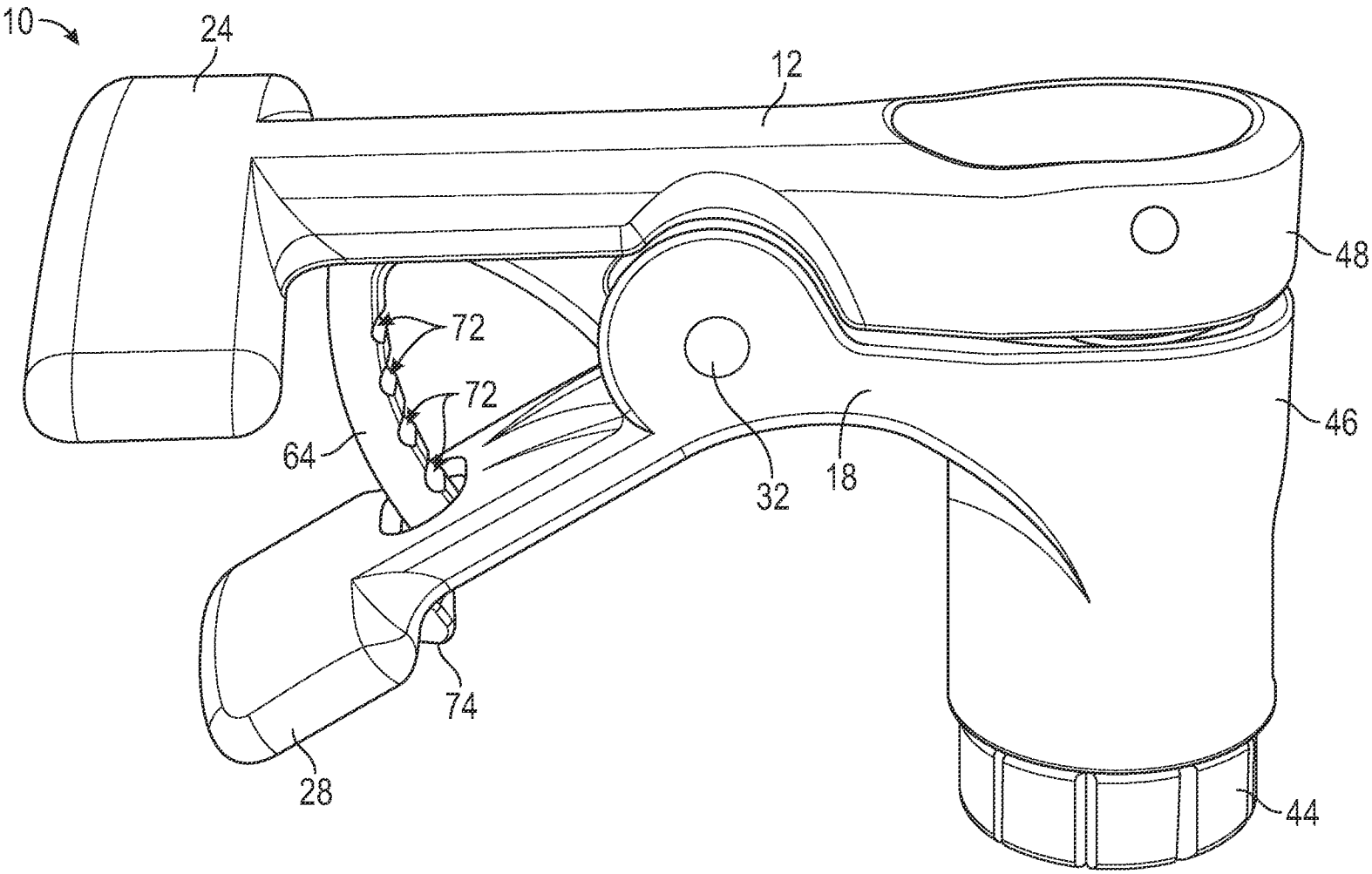
FIG. 10 shows a side perspective view of an alternative embodiment of a finger exercise device in accordance with the present disclosure.
Figure 11:
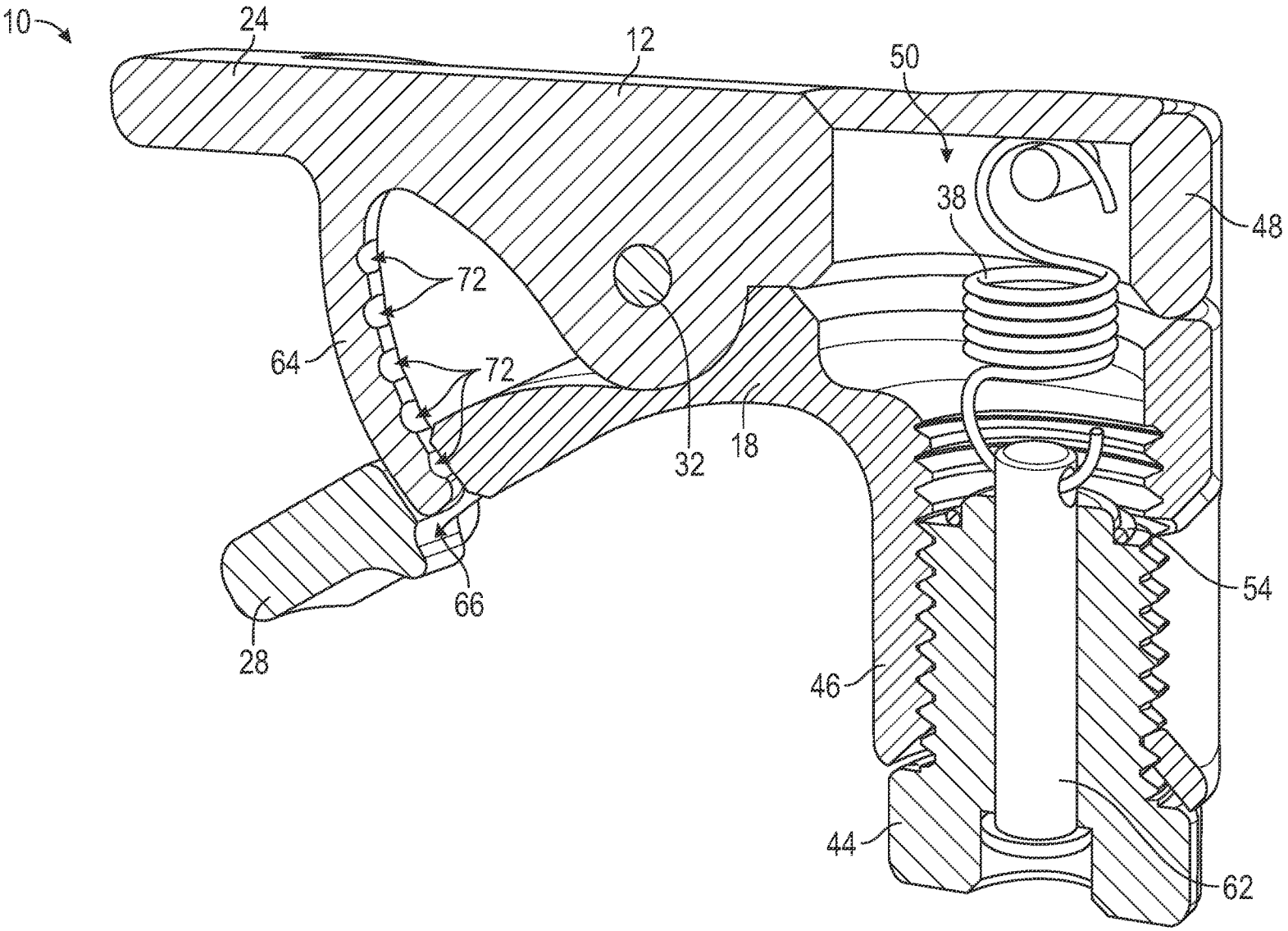
FIG. 11 shows a perspective cross sectional view of an alternative embodiment of a finger exercise device in accordance with the present disclosure.

In one aspect, a finger exercise device 10 for exercising and strengthening muscles in the fingers and hand of a user is provided. FIGS. 1-9 illustrate a preferred embodiment of the device 10. FIGS. 10-11 illustrate an alternative embodiment of the device 10. The device 10 comprises a first arm member 12 and a second arm member 18. The first arm member 12 has a first end 14 and an opposing second end 16, and the second arm member 18 also has a first end 20 and an opposing second end 22. The first arm member 12 and the second arm member 18 are pivotally attached to each other by a pivot pin 32 that allows rotational movement of the first arm member 12 and the second arm member 18 relative to each other. The first 12 and second 18 arm members rotate about an axis defined by pivot pin 32. As best seen in FIG. 3, the first end 14 of the first arm member 12 and the first end 20 of the second arm member 18 are disposed on the same side 34 of the pivot pin 32, and the second end 16 of the first arm member 12 and the second end 22 of the second arm member 18 are also disposed on the same side 36 of pin 32, which is an opposing side 36 of the pivot pin 32 from the side 34 on which the first ends 14, 20 of each arm member 12, 18 are disposed. As best seen in FIG. 3, the pivot pin 32 is disposed at or generally near a midpoint of a longitudinal length of the device 10 so that a substantial portion of each arm member 12 and 18 is disposed on each side 34, 36 of the pivot pin 32.

Figure 4:
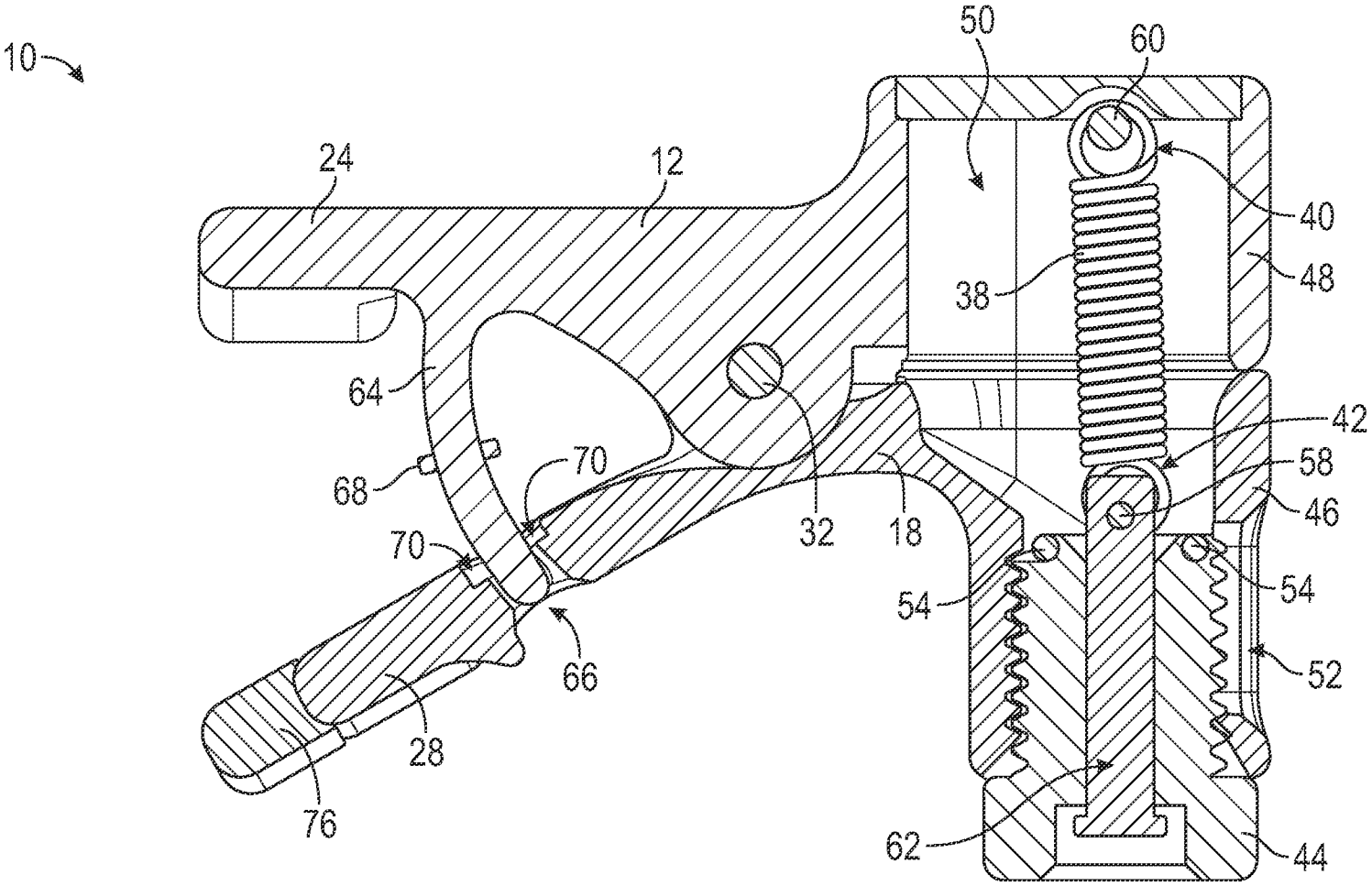
FIG. 4 shows a side cross sectional view of a finger exercise device in a static position in accordance with the present disclosure.
Figure 5:
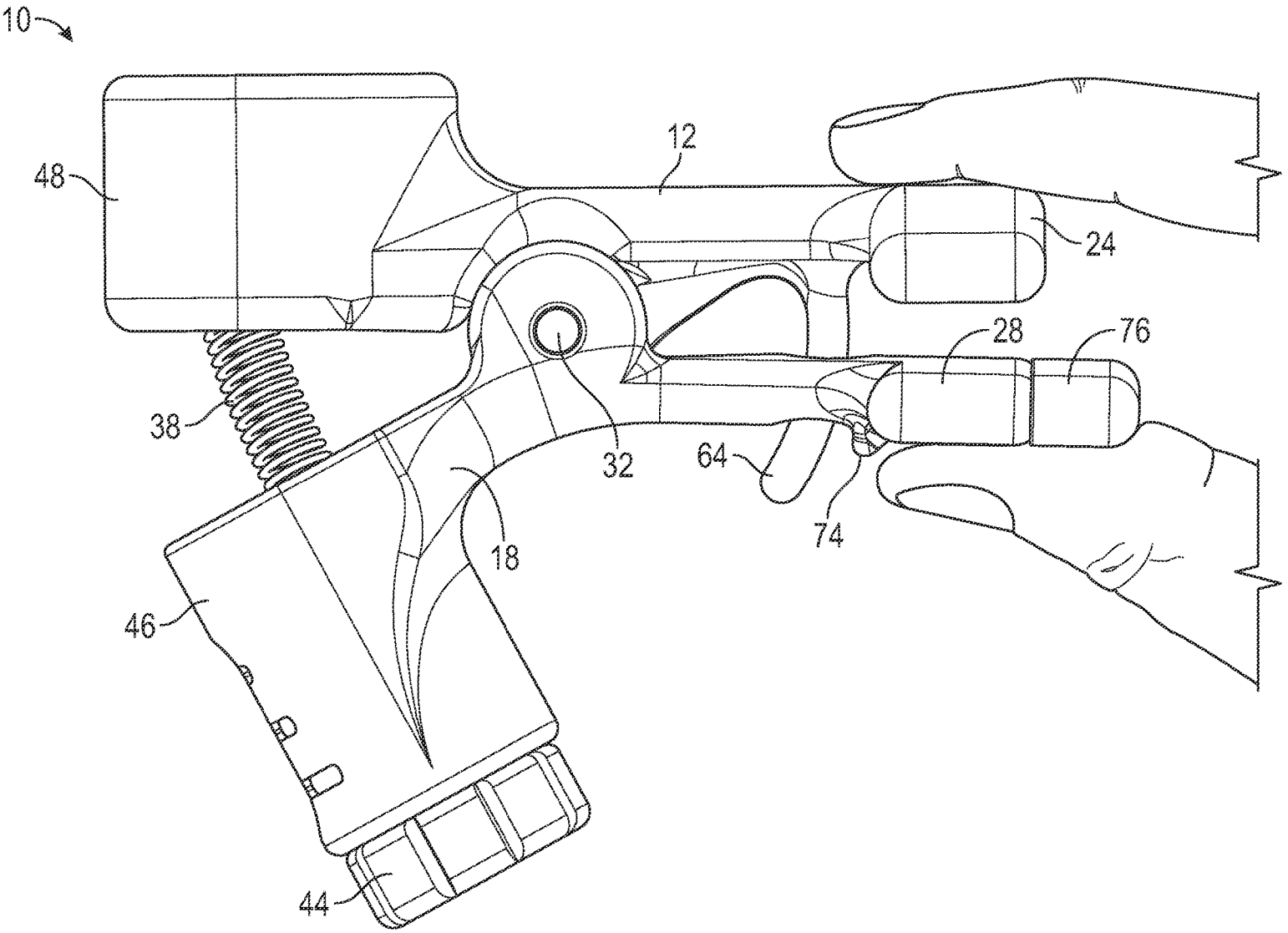
FIG. 5 shows a side elevational view of a finger exercise device in an extended position as the device is being used to exercise a user's fingers in accordance with the present disclosure.
Figure 6:
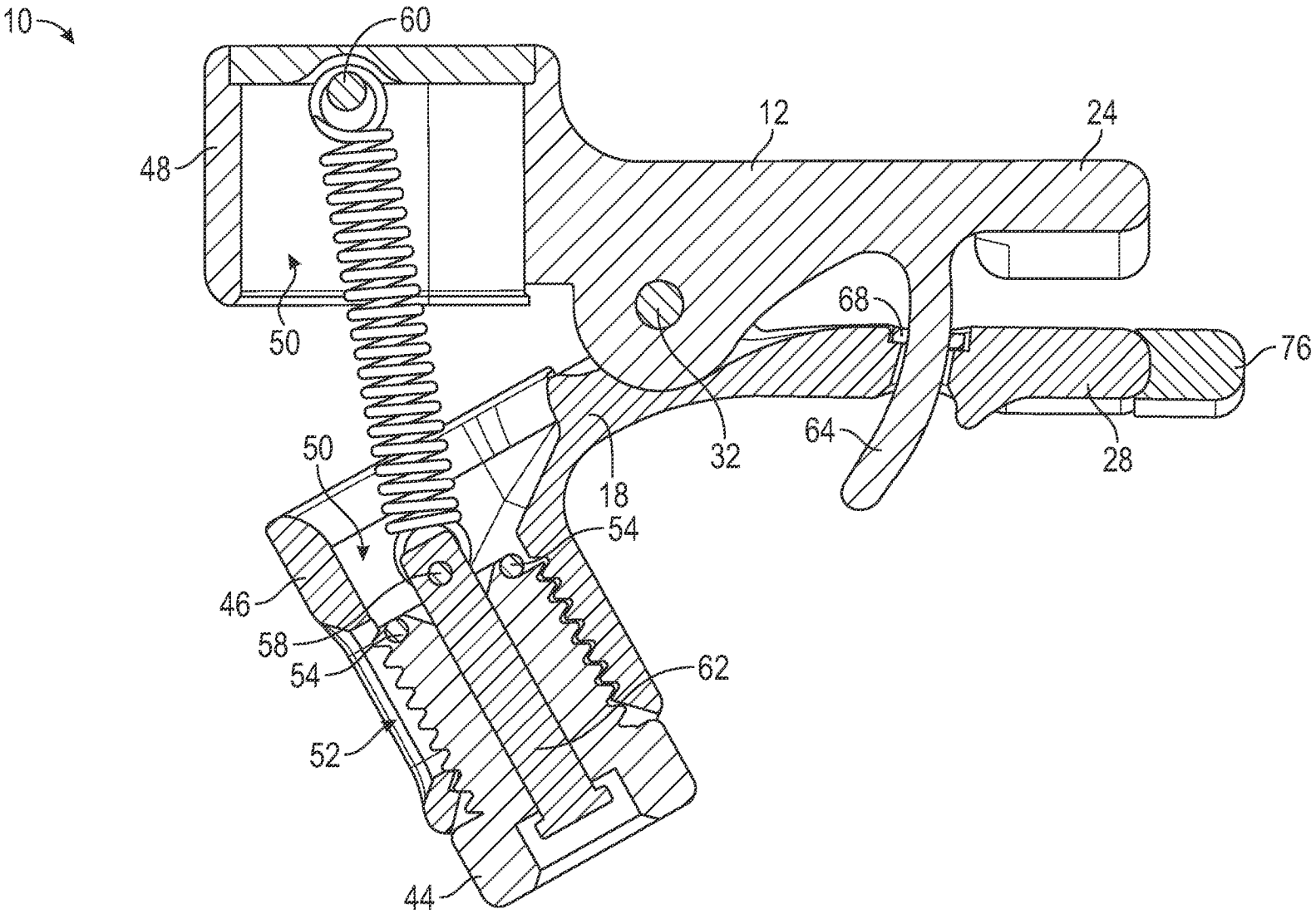
FIG. 6 shows a side cross sectional view of a finger exercise device in an extended position in accordance with the present disclosure.

As best seen in FIG. 4, which shows a cross section of the device 10 as viewed in FIG. 3, the device 10 further comprises a tension spring 38 having a first end 40 and an opposing second end 42. The first end 40 of the spring 38 is connected to the second end 16 of the first arm member 12, and the second end 42 of the spring 38 is connected to the second end 22 of the second arm member 18. The device 10 is configured to move between a static position, as best seen in FIGS. 1-4, and an extended position, as best seen in FIGS. 5-6. In the static position, the second end 16 of the first arm member 12 and the second end 22 of the second arm member 18 are in contact with each other and retained in place by the tension of the spring 38. In the extended position, the second end 16 of the first arm member 12 and the second end 22 of the second arm member 18 are separated from each other in response to rotational movement of the first arm member 12 and the second arm member 18 relative to each other. When not in use, the tension force of the spring 38 retains the device 10 in the static position.

The first end 14 of the first arm member 12 defines a first finger engagement portion 24, and the first end 20 of the second arm member 18 defines a second finger engagement portion 28. A user may engage the first 24 and second 28 finger engagement portions with their fingers to perform exercises using the device 10. In a preferred embodiment, the first finger engagement portion 24 is designed to be engaged with one or more fingers other than the user's thumb, and the second finger engagement portion 28 is designed to be engaged with the user's thumb, as best seen in FIG. 5. For instance, the user may engage the first finger engagement portion 24 with their index finger or with both their index finger and middle finger, and may engage the second finger engagement portion 28 with their thumb to perform a pinching or grasping motion when using the device 10.

In a preferred embodiment, the first finger engagement portion 24 comprises a curved element having a concave side 26 and a convex side 27.

Similarly, the second finger engagement portion 28 preferably comprises a curved element having a convex side 30 and a concave side 31. As best seen in FIGS. 1 and 2, the concave side 26 of the first finger engagement portion 24 faces toward the second arm member 18, and the convex side 30 of the second finger engagement portion 28 faces toward the first arm member 12. Thus, the convex side 27 of the first finger engagement portion 24 faces away from the second arm member 18, and the concave side 31 of the second finger engagement portion 28 faces away from the first arm member 12. As best seen in FIG. 5, the user's fingers thus engage the convex side 27 of the first finger engagement portion 24 and the concave side 31 of the second finger engagement portion 28. Thus, the convex side 27 of the first finger engagement portion 24 may function as a curved finger pad, and the concave side 31 of the second finger engagement portion 28 may function as a thumb saddle, which provides an ergonomic design of the device 10 that allows the user to use the device while enhancing the health and comfort of the user during use of the device 10. As best seen in FIGS. 1-6, the device 10 may optionally include a removable thumb extension 76 that may be attached to the second finger engagement portion 28, which helps to accommodate users with different hand sizes to provide a universal design. The thumb extension 76 may be removed from the second arm member 18 and preferably has the same general shape as the second finger engagement portion 28, including concave and convex sides, so that the extension 76 fits flush with the second finger engagement portion 28. In a preferred embodiment, the second arm member 18 also includes a thumb protrusion 74 positioned to provide a tactile indicator to the user as to where to place the user's thumb so that the thumb does not obstruct opening 66 through which curved arm 64 moves during normal use of the device 10.

The first arm member 12 and the second arm member 18 rotate relative to each other within a same plane that is perpendicular to the axis defined by pivot pin 32 and parallel a longitudinal axis 80 of the device 10. As shown in FIG. 3, the longitudinal axis 80 generally extends from the first ends 14, 20 of the arm members on the first side 34 to the second ends 16, 22 of the arm members on the second side 36 of the device 10 and is perpendicular to the axis defined by pivot pin 32. The axis defined by pivot pin 32 extends directly out of the drawing at pin 32 as viewed in FIG. 3. The first end 14 of arm 12 and the first end 20 of arm 18 are disposed at an angle relative to each other to allow ends 14 and 20 to move toward each other when arms 12 and 18 are rotated about pin 32 to extend the spring 38, which causes the second end 16 of arm 12 and the second end 22 of arm 18 to move away from each other, as best seen in FIG. 5. The second end 16 of arm 12 and the second end 22 of arm 18 are preferably configured to fit flush together in a position contacting each other when the device 10 is in the static position with the tension spring 38 fully compressed, as best seen in FIG. 3. The first end 14 of arm 12 and the first end 20 of arm 18 are disposed at an angle relative to each other to allow the arms 12 and 18 to pivot toward each other and also to allow the user to comfortably and ergonomically engage the first 24 and second 28 finger engagement portions with the user's thumb and one or more other fingers.

The first 24 and second 28 finger engagement portions preferably extend laterally outward relative to axis 80 to provide adequate surface are for the user to engage these portions with their fingers. In a preferred embodiment, the first finger engagement portion 24 is laterally wider than the second finger engagement portion 28. The first finger engagement portion 24 is preferably wide enough to provide sufficient surface are for the user to engage this portion 24 with up to four fingers, including the index finger, middle finger, ring finger, and pinky finger, and the second finger engagement portion 28 is preferably wide enough to provide sufficient surface are for the user to engage this portion 28 with only the user's thumb. Although the first 24 and second 28 finger engagement portions are preferably curved for ergonomic and comfort purposes, the finger engagement portions may alternatively be of a generally flat shape.

The device 10 further comprises a force adjuster knob 44 configured to adjust tension on the spring 38, thereby adjusting the amount of force required to be exerted by the user to pivot the first 24 and second 28 finger engagement portions toward each other in a pinching or grasping motion. In a preferred embodiment, the force adjuster knob 44 is connected to the second end 22 of the second arm member 18. Preferably, the force adjuster knob 44 is threadedly connected to the second end 22 of the second arm member 18. In a preferred embodiment, as best seen in FIG. 4, the first end 40 of the spring 38 is connected to the second end 16 of the first arm member 12, and the second end 42 of the spring 38 is connected to the force adjuster knob 44 that is connected to the second end 22 of the second arm member 18. The force adjuster knob 44 is configured to adjust tension on the spring 38, preferably in response to rotation of the force adjuster knob 44, which extends or compresses the spring 38 depending on the direction of rotation of the knob 44. In a preferred embodiment, as best seen in FIG. 4, the force adjuster knob 44 rotates about an axis that is generally parallel with an axis of the spring 38 when the device 10 is in the static position.

In a preferred embodiment, as best seen in FIGS. 4 and 6, the second end 16 of the first arm member 12 and the second end 22 of the second arm member 18 form a housing having a hollow interior 50 in which the spring 38 is disposed. The housing is defined by a lower housing 46, which is formed by portions of the second end 22 of the second arm member 18, and an upper housing 48, which is formed by portions of the second end 16 of the first arm member 12. In a preferred embodiment, the upper 48 and lower 46 housings form a generally enclosed space 50 when the first 12 and second 18 arm members are contacting each other when the device 10 is in the static position, as shown in FIG. 4, and the upper 48 and lower 46 housings separate from each other to expose the spring 38 and interior 50 of the housing when the device 10 is in the extended position, as shown in FIG. 6. As best seen in FIGS. 4, 6, and 11, each end 40, 42 of the spring 38 may comprise a loop or hook to attach the spring 38 to the first 12 and second 18 arm members. In a preferred embodiment, as best seen in FIGS. 4 and 9, the first end 40 of the spring 38 may be connected to an upper retaining pin 60, which may be secured to the upper housing 48, and the second end 42 of the spring 38 may be connected to a lower retaining pin 58, which may be secured to the force adjuster knob 44. Alternatively, the first end 40 of the spring 38 may be connected to another component of the upper housing 48. In another alternative embodiment, the second end 42 of the spring 38 may be connected directly to the force adjuster knob 44, as shown in FIG. 11.

Figure 7:
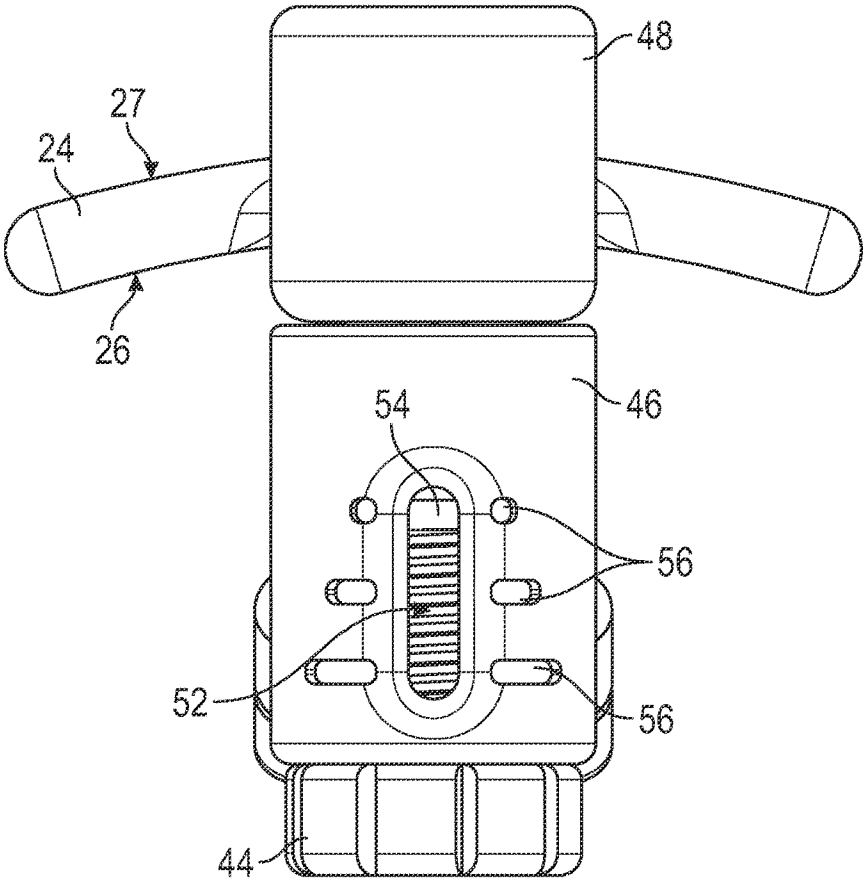
FIG. 7 shows a front view of a finger exercise device in accordance with the present disclosure.

The force adjuster knob 44 preferably has male threads that are compatible with female threads disposed at a lower open end of the lower housing 46. A portion of the force adjuster knob 44 is disposed outside of the lower housing 46 so that the user can manually rotate the knob 44 to adjust the tension on the spring 38. In a preferred embodiment, as best seen in FIGS. 1, 7, and 8, the lower housing 46 has an indicator window 52 through which portions of the force adjuster knob 44 are visible from an exterior of the housing 46. In a preferred embodiment, the force adjuster knob 44 comprises a visible marking 54 disposed in a fixed position on the force adjuster knob 44 and that is visible from the exterior of the housing 46. As shown in FIGS. 7 and 8, the marking 54 changes position within the indicator window 52 in response to rotation of the force adjuster knob 44, which allows the user to visually determine the force setting of the force adjuster knob 44 by visually observing the position of the marking 54 within the indicator window 52. In one embodiment, as best seen in FIGS. 4 and 11, the visible marking 54 may comprise an O-ring disposed in a fixed position around a portion of the force adjuster knob 44 at an end of the threads and opposite the end of the knob 44 that extends from the lower housing 46 for manual rotation of the knob 44. Alternatively, other types of visible markings may be utilized that are fixed at a position on the knob 44, such as a portion of the knob 44 being a different color than the rest of the knob 44 to provide a visual indicator of the position of the knob 44. The exterior of the lower housing 46 preferably also includes exterior markings 56 disposed adjacent to the indicator window 52 to allow the user to visually determine the force setting of the force adjuster knob 44 by visually comparing the position of the marking 54 to the exterior markings 56.

To allow the force adjuster knob 44 to rotate without rotating the spring 38 that is connected to the knob 44, in a preferred embodiment, as best seen in FIGS. 4 and 9, the knob 44 comprises an elongated rod 62 extending longitudinally through an internal opening that extends through the portion of the knob 44 that rotates. The rod 62 can freely rotate within the internal opening so that the rod 62 can remain in a rotationally fixed position as the knob 44 rotates around the rod 62. The second end 42 of the spring 38 is connected to one end of the rod 62 either directly or using retaining pin 58, which may be disposed within a transverse opening extending through the rod 62. The rod 62 has a flanged end 82 opposite the end to which the spring 38 is connected. The flanged end 82 has a larger diameter than the internal opening in which the rod 62 is disposed so that rotational movement of the knob 44 in a direction to extend the spring 38 forces the rod 62 to move in an axially outward direction with the knob 44, thereby causing the spring 38 to extend. When the knob 44 is rotated in a direction to allow the tension force of the spring 38 to compress the spring 38, the tension force of the spring 38 causes the rod 62 to move in an axially inward direction with the knob 44. FIG. 7 illustrates the knob 44 threaded inwardly to allow full compression of the spring 38. FIG. 8 illustrates the knob 44 threaded outwardly to extend the spring 38 to a position in which the spring 38 is extended to approximately half the extension allowed by the configuration of the knob 44, as indicated by the position of marking 54 within indicator window 52. Thus, by using the knob 44 to extend the spring 38, the spring 38 may be partially extended to varying degrees while the device 10 remains in the static position. In this manner, the knob 44 may be used to set a baseline static position from which the user begins to use the device 10 to further extend the spring 38 by forcibly pivoting arms 12 and 18 toward each other.

In a preferred embodiment in which retaining pin 58 is utilized to connect the spring 38 to rod 62, the lower housing 46 has two opposing channels 78 disposed within an interior wall of the lower housing 46. As best seen in FIG. 9, the channels 78 are disposed on opposing sides of the housing 46 and extend longitudinally for a distance within the housing 46. Opposing ends of the retaining pin 58 are disposed within each one of the opposing channels 78, which prevents the retaining pin 58 from rotating within the housing 46 with the knob 44 when the knob 44 is rotated to adjust tension in the spring 38. Thus, the configuration of the retaining pin 58 and channels 78 mechanically prevents rod 62 from rotating with the knob 44. As the knob 44 is rotated and thus moves in an axial direction, the opposing ends of the retaining pin 58 may slide back and forth as required within each of the channels 78. In a preferred embodiment, the channels 78 do not extend the entire length of the lower housing 46 so that the channels 78 limit the axially outward movement of the retaining pin 58, which prevents the knob 44 from being completely unthreaded from the lower housing 46.

In a preferred embodiment, as best seen in FIG. 3, the device 10 further comprises a curved arm 64 attached to the first arm member 12. The curved arm 64 extends from the first arm member 12 toward the second arm member 18, which has an opening 66 extending through the second arm member 18. The curved arm 64 is slidably disposed within the opening 66 so that the curved arm 64 can freely slide through the opening 66 and back and forth within the opening 66 as the first end 14, of each of the arm members 12, 18 are pivoted toward each other to extend the spring 38 and away from each other to allow the spring 38 to return to a compressed state. In a preferred embodiment, as best seen in FIG. 4, the curved arm 64 is designed so that a distal end of the arm 64 is disposed generally within opening 66 when the device 10 is in the static position. FIG. 5 shows the curved arm 64 in a position in which the arm 64 has partially moved through opening 66 as the user pivots arm members 12 and 18 toward each other to extend the spring 38. The curved arm 64 includes an indicator that visually indicates how far the curved arm 64 has slidably moved through the opening 66, which indicates the degree of extension of the spring 38 due to the pivoting movement of arm members 12 and 18, thereby providing an indication of the pinching or grasping force exerted on arm members 12 and 18 by the user.

In a preferred embodiment, as best seen in FIGS. 3 and 4, the device 10 further comprises a friction ring 68 disposed around the curved arm 64. A position of the friction ring 68 is adjustable along a length of the curved arm 64 so that the ring 68 can be set in any desired position along the length of the arm 64. The ring 68 is preferably made of a rubber material, or similar material, and is sized to fit tightly around the arm 64. The rubber material provides sufficient friction with the exterior surface of the curved arm 64 so that the ring 68 generally stays in a fixed position on the arm 64 unless the user forcibly moves the ring 68 to a different position. In this embodiment, as best seen in FIG. 4, the second arm member 18 preferably has a recess 70 disposed circumferentially around the opening 66 extending through the second arm member 18. The recess 70 is disposed on the side of the second arm member 18 facing the first arm member 12 and is sized to receive the friction ring 68 therein, which generally prevents further movement of the curved arm 64 through the opening 66. This allows the user to gauge the user's progress in strengthening muscles in the hand and fingers based on the positioning of the ring 68 on arm 64, which is advantageous for users who are using the device 10 for rehabilitation following significant injury. In such cases, the user may not be physically capable of fully extending the spring 38 to the extent allowed by the device 10. In this case, the user can position the friction ring 68 relatively close to the distal end of the curved arm 64 and determine whether the user is capable of extending the spring 38 to a degree in which ring 68 moves into recess 70, which then prevents further movement of the arm 64 through opening 66. If the user is capable of this movement, this will set a baseline for evaluation of future progress. The user may then move the friction ring 68 further away from the distal end of the arm 64, which allows further extension of the spring 38, and reevaluate the user's progress. This process may be repeated to further evaluate the user's progress.

In an alternative embodiment, as shown in FIGS. 10 and 11, the curved arm 64 has a plurality of notches 72 disposed along a length of the curved arm 64. The plurality of notches 72 are preferably disposed along the length of the curved arm 64 in an equidistantly spaced relationship. In this embodiment, the notches 72 provide a visual indicator of how far the curved arm 64 slides through opening 66 each time the user moves the arm members 12 and 18 together to extend the spring 38. Thus, the user may evaluate progress by observing which of the notches 72 is positioned adjacent to opening 66 when the user extends the spring 38 to the greatest extent of the user's capability. In this embodiment, the curved arm 64 moves freely through opening 66 in an unobstructed manner, which allows for evaluation of improvement during a single session without the need for modifying the device 10, such as by having to manually move friction ring 68.

In the alternative embodiment shown in FIG. 11, the device 10 optionally utilizes a shorter spring 38 than in the embodiment shown in FIG. 4. The shorter and longer springs may have different tension forces required to extend each spring a defined distance, which may allow the device 10 to be optimized for users of varying capability. In this embodiment, the top of the upper housing 48 may be generally flat as the first arm member 12 extends from the first end 14 on the first side 34 of pivot pin 32 to the second end 16 on the second side 36 of pivot pin 32, as the housing 48 can be smaller when being used to accommodate a smaller spring 38. It should be understood by one of skill in the art that tension springs 38 of varying size and having varying tension forces may be utilized with the device 10 and still fall within the scope of the present disclosure. As a user progresses through rehabilitation of their hands and/or fingers, different devices 10 with springs 38 having different tension forces may be utilized to increase the required force for extension of the spring 38 over time.

To use the device 10, a user first sets the desired tension force required to extend the spring 38 using the force adjuster knob 44. The user may rotate the knob 44 to move the knob 44 axially inward toward the spring 38 to reduce the tension force required to extend the spring 38, or alternatively the user may rotate the knob 44 to move the knob 44 axially outward away from the spring 38 to increase the tension force required to extend the spring 38. Moving the knob 44 outward extends the spring 38 to a baseline extension degree before the user begins using the device 10, thereby increasing the force required to be exerted by the user on the first 24 and second 28 finger engagement portions to further extend the spring 38 to a defined extent, for example, to a point at which the friction ring 68 is moved into recess 70 when the friction ring 68 is positioned at a preset location on the curved arm 64. When the knob 44 is moved fully inward to fully compress the spring 38, less force is required to be exerted by the user to move the first and second arm members 12 and 18 to the same position in which the friction ring 68 is moved into recess 70 when the friction ring 68 is positioned at the same preset location.

The user then engages the first 24 and second 28 finger engagement portions with their fingers. For instance, the user may engage the first finger engagement portion 24 with their index finger and middle finger and also engage the second finger engagement 28 portion with their thumb, as shown in FIG. 5. The user may then perform a pinching or grasping motion to pivot the first and second arm members 12 and 18 relative to each other, which extends the spring 38 and thus moves the device 10 from the static position into the extended position. The extended position encompasses a range of motion of the first and second arm members 12 and 18 relative to each other and thus a range of tensioning force on the spring 38. Thus, the extended position encompasses any extension of the spring 38 beyond a baseline extension as set by adjusting knob 44 so that the second ends 16, 22 of each arm member 12, 18 are separated from each other due to pivoting of the arm members 12, 18 relative to each other. The extended position may encompass a range of motion between a baseline static position and a position of full extension of the spring 38, which is limited by the range of possible pivoting motion of the first and second arm members 12 and 18 relative to each other. The range of pivoting motion may be limited by the angle at which the first end 14 of arm 12 and the first end 20 of arm 18 are disposed relative to each other, in which case full extension of the spring 38 may be defined by the degree of extension of the spring 38 at which the first end 14 of arm 12 and the first end 20 of arm 18 contact each other, thereby preventing further pivoting motion of the arm members 12 and 18 relative to each other.

The present device 10 may be used by the user in different positions, such as with the user's palm turned either upward or downward to exercise and strengthen different muscles. The device 10 is particularly advantageous in working the flexor *pollicis longus* and *brevis* musculature, the *opponens pollicis* and *abductor pollicis brevis*, and the *abductor pollicis*. The device 10 is particularly advantageous in working the flexor digitoroum *superficialis* and *profundus* muscles when using the device to perform a three-point pinch utilizing the index finger, middle finger, and thumb.

It will be appreciated that the configurations and methods shown and described herein are illustrative only, and that these specific examples are not to be considered in a limiting sense, because numerous variations are possible. The subject matter of the present disclosure includes all novel and non-obvious combinations and sub-combinations of the various systems and configurations, and other features, functions, and/or properties disclosed herein. It is understood that versions of the invention may come in different forms and embodiments. Additionally, it is understood that one of skill in the art would appreciate these various forms and embodiments as falling within the scope of the invention as disclosed herein.

What is claimed is:

1. An exercise device comprising:

a first arm member having a first end and an opposing second end;

a second arm member having a first end and an opposing second end, wherein the first arm member and the second arm member are pivotally attached to each other by a pivot pin that allows rotational movement of the first arm member and the second arm member relative to each other about an axis of the pivot pin, wherein the first end of the first arm member and the first end of the second arm member are disposed on a first same side of the pivot pin, wherein the second end of the first arm member and the second end of the second arm member are disposed on an opposing second same side of the pivot pin, wherein the first end of the first arm member defines a first finger engagement portion and the first end of the second arm member defines a second finger engagement portion;

a tension spring having a first end and an opposing second end; and a force adjuster knob connected to the second end of the second arm member, wherein the first end of the spring is connected to the second end of the first arm member and the second end of the spring is connected to the force adjuster knob, wherein the force adjuster knob is configured to adjust tension on the spring, and wherein the force adjuster knob comprises a visible marking disposed in a fixed position on the force adjuster knob, wherein the force adjuster knob is threaded into a threaded housing that has an indicator window through which the marking is visible from an exterior of the housing, wherein the marking changes position within the indicator window in response to rotation of the force adjuster knob.

2. The exercise device of claim 1, wherein the exercise device is configured to move between a static position and an extended position, wherein the second end of the first arm member and the second end of the second arm member are in contact with each other and retained in place by the tension of the spring when the exercise device is in the static position, wherein the second end of the first arm member and the second end of the second arm member are separated from each other in response to rotational movement of the first arm member and the second arm member relative to each other when the exercise device is moved from the static position to the extended position.

3. The exercise device of claim 1, wherein the first finger engagement portion comprises a curved member having a concave side that faces toward the second arm member.

4. The exercise device of claim 1, wherein the second finger engagement portion comprises a curved member having a convex side that faces toward the first arm member.

5. The exercise device of claim 1, wherein the force adjuster knob is threadedly connected to the second end of the second arm member, wherein the force adjuster knob is configured to adjust tension on the spring in response to rotation of the force adjuster knob, wherein the force adjuster knob rotates about an axis that is generally parallel with an axis of the spring when the spring is not extended.

6. A method of exercising, said method comprising the steps of:

providing an exercise device comprising:

a first arm member having a first end and an opposing second end, a second arm member having a first end and an opposing second end, wherein the first arm member and the second arm member are pivotally attached to each other by a pivot pin that allows rotational movement of the first arm member and the second arm member relative to each other about an axis of the pivot pin, wherein the first end of the first arm member and the first end of the second arm member are disposed on a first same side of the pivot pin, wherein the second end of the first arm member and the second end of the second arm member are disposed on an opposing second same side of the pivot pin, wherein the first end of the first arm member defines a first finger engagement portion and the first end of the second arm member defines a second finger engagement portion, a tension spring having a first end and an opposing second end, and a force adjuster knob connected to the second end of the second arm member, wherein the first end of the spring is connected to the second end of the first arm member and the second end of the spring is connected to the force adjuster knob, wherein the force adjuster knob is configured to adjust tension on the spring in response to rotation of the force adjuster knob, wherein the force adjuster knob comprises a visible marking disposed in a fixed position on the force adjuster knob, wherein the force adjuster knob is threaded into a threaded housing that has an indicator window through which the marking is visible from an exterior of the housing, wherein the marking changes position within the indicator window in response to rotation of the force adjuster knob;

rotating the force adjuster knob to set a baseline tension force on the spring;

a user engaging the second finger engagement portion with the user's thumb and engaging the first finger engagement portion with one or more fingers other than the thumb; and the user performing a motion with the user's fingers to pivotally move the first end of the first arm member and the first end of the second arm member toward each other, thereby extending the spring by moving the second end of the first arm member and the second end of the second arm member away from each other.

7. The method of claim 6, wherein the exercise device further comprises a curved arm attached to the first arm member, wherein the curved arm extends from the first arm member toward the second arm member, wherein the second arm member has an opening extending through the second arm member, wherein the curved arm is slidably disposed within the opening, wherein the step of the user performing a motion with the user's fingers to pivotally move the first end of the first arm member and the first end of the second arm member toward each other comprises the curved arm sliding through the opening as the first end of the first arm member and the first end of the second arm member move toward each other.

8. The method of claim 7, wherein the exercise device further comprises a friction ring disposed around the curved arm, wherein a position of the friction ring is adjustable along a length of the curved arm.

9. The method of claim 8, wherein the second arm member has a recess disposed circumferentially around the opening extending through the second arm member, wherein the recess is sized to receive the friction ring therein.

10. The method of claim 7, wherein the curved arm has a plurality of notches along a length of the curved arm, wherein the plurality of notches are disposed along the length of the curved arm in an equidistantly spaced relationship.

11. The method of claim 6, wherein the exercise device is configured to move between a static position and an extended position, wherein the second end of the first arm member and the second end of the second arm member are in contact with each other and retained in place by the tension of the spring when the exercise device is in the static position, wherein the second end of the first arm member and the second end of the second arm member are separated from each other in response to rotational movement of the first arm member and the second arm member relative to each other when the exercise device is moved from the static position to the extended position.

12. The method of claim 6, wherein the first finger engagement portion comprises a curved member having a concave side and a convex side, wherein the concave side faces toward the second arm member, wherein the step of the user engaging the first finger engagement portion with one or more fingers other than the thumb comprises the user engaging the convex side of the first finger engagement portion.

13. The method of claim 6, wherein the second finger engagement portion comprises a curved member having a concave side and a convex side, wherein the convex side faces toward the first arm member, wherein the step of the user engaging the second finger engagement portion with the user's thumb comprises the user engaging the concave side of the second finger engagement portion.

14. The method of claim 6, wherein the force adjuster knob rotates about an axis that is generally parallel with an axis of the spring when the spring is not extended.

15. An exercise device comprising:

a first arm member having a first end and an opposing second end;

a second arm member having a first end and an opposing second end, wherein the first arm member and the second arm member are pivotally attached to each other by a pivot pin that allows rotational movement of the first arm member and the second arm member relative to each other about an axis of the pivot pin, wherein the first end of the first arm member and the first end of the second arm member are disposed on a first same side of the pivot pin, wherein the second end of the first arm member and the second end of the second arm member are disposed on an opposing second same side of the pivot pin, wherein the first end of the first arm member defines a first finger engagement portion and the first end of the second arm member defines a second finger engagement portion;

a curved arm attached to the first arm member, wherein the curved arm extends from the first arm member toward the second arm member, wherein the second arm member has an opening extending through the second arm member, wherein the curved arm is slidably disposed within the opening;

a tension spring having a first end and an opposing second end; and a force adjuster knob connected to the second end of the second arm member, wherein the first end of the spring is connected to the second end of the first arm member and the second end of the spring is connected to the force adjuster knob, wherein the force adjuster knob is configured to adjust tension on the spring.

16. The exercise device of claim 15, further comprising a friction ring disposed around the curved arm, wherein a position of the friction ring is adjustable along a length of the curved arm.

17. The exercise device of claim 16, wherein the second arm member has a recess disposed circumferentially around the opening extending through the second arm member, wherein the recess is sized to receive the friction ring therein.

18. The exercise device of claim 15, wherein the curved arm has a plurality of notches along a length of the curved arm, wherein the plurality of notches are disposed along the length of the curved arm in an equidistantly spaced relationship.

19. The exercise device of claim 15, wherein the exercise device is configured to move between a static position and an extended position, wherein the second end of the first arm member and the second end of the second arm member are in contact with each other and retained in place by the tension of the spring when the exercise device is in the static position, wherein the second end of the first arm member and the second end of the second arm member are separated from each other in response to rotational movement of the first arm member and the second arm member relative to each other when the exercise device is moved from the static position to the extended position.

20. The exercise device of claim 15, wherein the force adjuster knob comprises a visible marking disposed in a fixed position on the force adjuster knob, wherein the force adjuster knob is threaded into a threaded housing that has an indicator window through which the marking is visible from an exterior of the housing, wherein the marking changes position within the indicator window in response to rotation of the force adjuster knob.

* * * * *